US010777113B2

(12) United States Patent
Ikeda et al.

(10) Patent No.: US 10,777,113 B2
(45) Date of Patent: Sep. 15, 2020

(54) DISPLAY DEVICE

(71) Applicant: Japan Display Inc., Minato-ku (JP)

(72) Inventors: Kojiro Ikeda, Minato-ku (JP); Masaaki Kabe, Minato-ku (JP); Akira Sakaigawa, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 347 days.

(21) Appl. No.: 14/933,369

(22) Filed: Nov. 5, 2015

(65) Prior Publication Data

US 2016/0155371 A1 Jun. 2, 2016

(30) Foreign Application Priority Data

Nov. 28, 2014 (JP) ..... 2014-241877

(51) Int. Cl.

| | |
|---|---|
| ***G09G 3/20*** | (2006.01) |
| ***G09G 3/3225*** | (2016.01) |
| ***G09G 3/36*** | (2006.01) |
| ***G09G 3/34*** | (2006.01) |

(52) U.S. Cl.

CPC ..... *G09G 3/2003* (2013.01); *G09G 3/2074* (2013.01); *G09G 3/3225* (2013.01); *G09G 3/3648* (2013.01); *G09G 3/3413* (2013.01); *G09G 2300/0452* (2013.01)

(58) Field of Classification Search

None

See application file for complete search history.

(56) References Cited

U.S. PATENT DOCUMENTS

| | | | | |
|---|---|---|---|---|
| 2004/0051724 | A1* | 3/2004 | Elliott | G02F 1/133514 345/694 |
| 2004/0095521 | A1 | 5/2004 | Song et al. | |
| 2004/0169807 | A1 | 9/2004 | Rho et al. | |
| 2008/0030660 | A1* | 2/2008 | Roth | G09G 3/3607 349/106 |
| 2009/0115952 | A1* | 5/2009 | Nakamura | G02B 5/201 349/143 |

(Continued)

FOREIGN PATENT DOCUMENTS

| | | |
|---|---|---|
| JP | 2010-33009 | 2/2010 |
| JP | 2010-526332 | 7/2010 |

(Continued)

OTHER PUBLICATIONS

Office Action dated Mar. 20, 2018, in Japanese Patent Application No. 2014-241877, filed Nov. 28, 2014, w/English-language Translation, 26 pages.

*Primary Examiner* — Temesghen Ghebretinsae
*Assistant Examiner* — Paras D Karki
(74) *Attorney, Agent, or Firm* — Oblon, McClelland, Maier & Neustadt, L.L.P.

(57) ABSTRACT

A display device includes a display unit in which a plurality of pixels are arranged. One pixel includes four sub-pixels, and the display unit includes: a pixel including one each of four sub-pixels of four different colors that are a first color, a second color, a third color, and a fourth color; and a pixel including four sub-pixels, where two of the four sub-pixels are identical and are one of sub-pixels of the first color, the second color, and the third color, and remaining two of the four sub-pixels are different two of the sub-pixels of the first color, the second color, and the third color but are not one of the identical sub-pixels.

7 Claims, 12 Drawing Sheets

(56) References Cited

U.S. PATENT DOCUMENTS

| | | | | |
|---|---|---|---|---|
| 2009/0315921 | A1 | 12/2009 | Sakaigawa et al. | |
| 2010/0141693 | A1 | 6/2010 | Lee et al. | |
| 2013/0021328 | A1* | 1/2013 | Yang ..... | G09G 3/3208 345/419 |

FOREIGN PATENT DOCUMENTS

| | | | |
|---|---|---|---|
| JP | 2012-083794 | A | 4/2012 |
| WO | WO 2008/130203 | A1 | 10/2008 |

* cited by examiner

DISPLAY DEVICE

CROSS-REFERENCE TO RELATED APPLICATION(S)

This application claims priority from Japanese Application No. 2014-241877, filed on Nov. 28, 2014, the contents of which are incorporated by reference herein in its entirety.

BACKGROUND

1. Technical Field

The present invention relates to a display device.

2. Description of the Related Art

Display devices using four colors, i.e., red (R), green (G), blue (B), and white (W) as colors of a plurality of sub-pixels constituting a pixel are publicly known. By including the W sub-pixel in addition to the R, G, and B sub-pixels, the display device can display a color including a white component more brightly.

However, the display device in which the pixel is constituted of sub-pixels of four colors includes the W sub-pixel, so that an area of a display region that can be allocated to the R, G, and B sub-pixels is reduced by an area of the W sub-pixel. Therefore, as compared with a display device in which the pixel is constituted only of the R, G, B sub-pixels, the display device described above has a problem that luminance of at least one or more colors among the three colors having large output values is lowered, such as luminance of a color (single color) represented by using any of the R, G, B sub-pixels.

Such a problem as described above is not limited to the display device using the four colors of R, G, B, and W as colors of sub-pixels, but is common to any display devices using four or more colors as colors of sub-pixels. In other words, in the display device including sub-pixels of four or more colors, an area of the sub-pixels that can be allocated to three colors, i.e., a first color, a second color, and a third color among the four or more colors is smaller as compared to the display device including the sub-pixels of only three colors.

For the foregoing reasons, there is a need for a display device that includes sub-pixels of four colors, i.e., a first color, a second color, a third color, and a fourth color, and can increase luminance of the first color, the second color, and the third color. Further, there is a need for a display device that can achieve an effect obtained by using the fourth color in addition to the first color, the second color, and the third color as the colors of the sub-pixels, while achieving higher luminance of the first color, the second color, and the third color at the same time.

SUMMARY

A display device includes a display unit in which a plurality of pixels are arranged. One pixel includes four sub-pixels, and the display unit includes: a pixel including one each of four sub-pixels of four different colors that are a first color, a second color, a third color, and a fourth color; and a pixel including four sub-pixels, where two of the four sub-pixels are identical and are one of sub-pixels of the first color, the second color, and the third color, and remaining two of the four sub-pixels are different two of the sub-pixels of the first color, the second color, and the third color but are not one of the identical sub-pixels.

DETAILED DESCRIPTION

Figure 1:
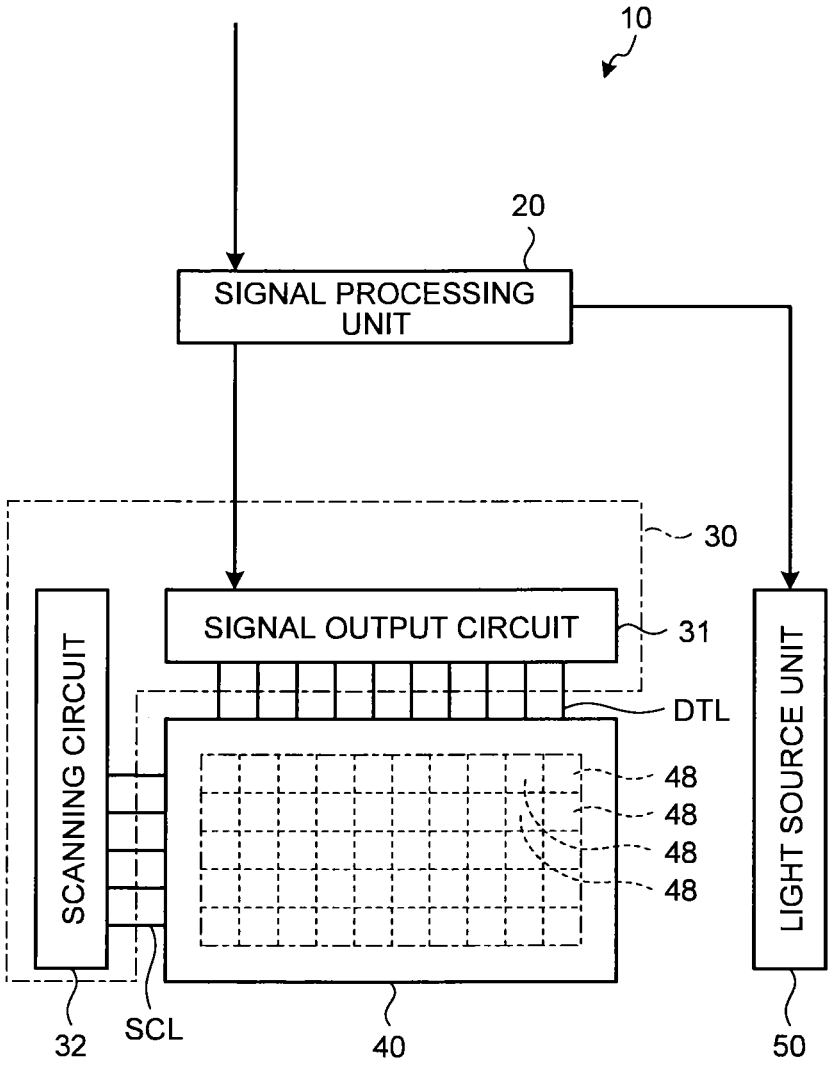
FIG. 1 is a block diagram illustrating a configuration example of a display device according to a first embodiment for implementing the present invention.

The following describes preferred embodiments for implementing the present invention in detail with reference to the accompanying drawings. The present invention is not limited to the embodiments described below. Components described below include a component that is easily conceivable by those skilled in the art, a component that is substantially identical thereto. Furthermore, the components described below may be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

First Embodiment

Figure 2:
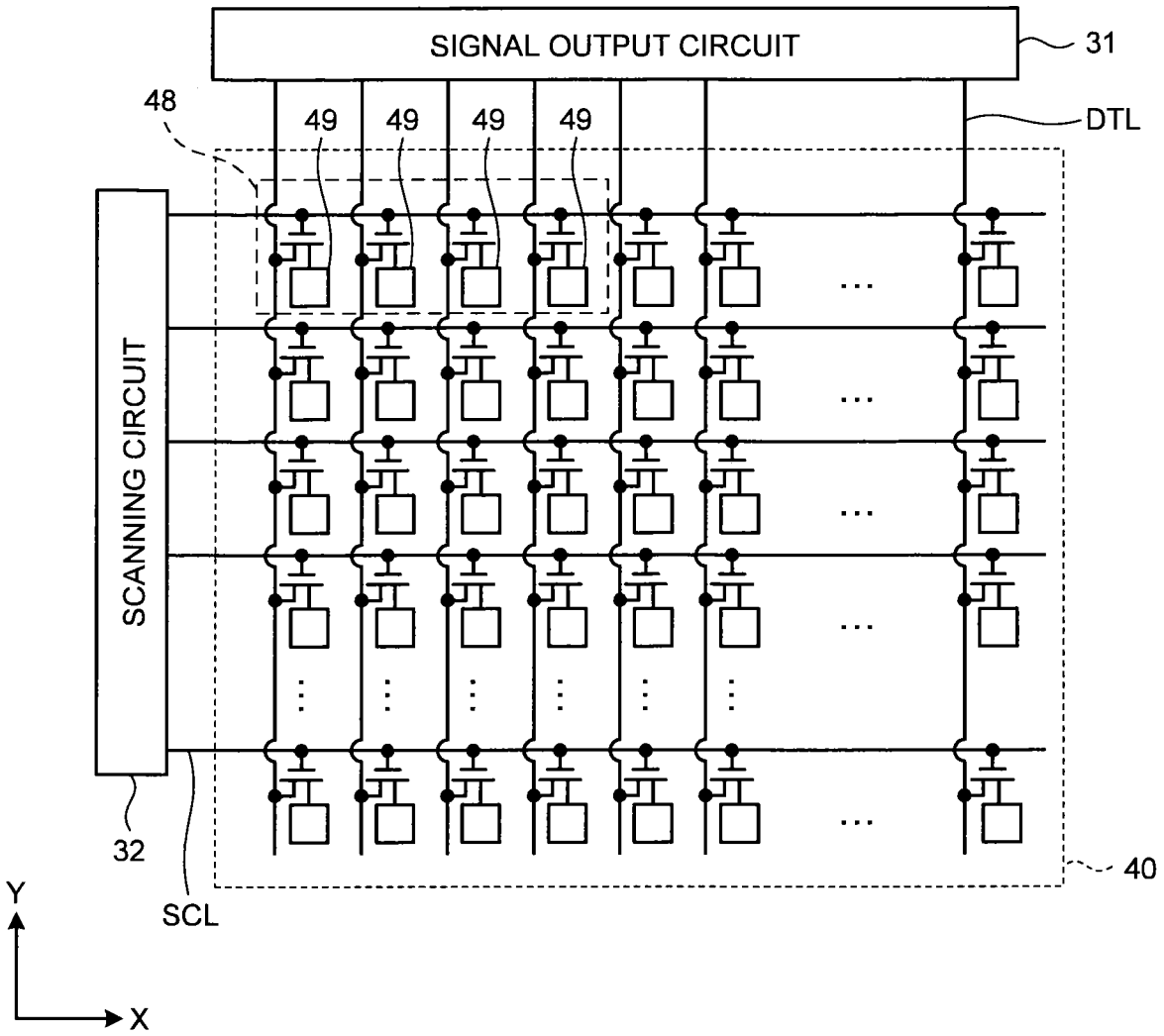
FIG. 2 is a conceptual diagram of an image display panel and an image display panel drive circuit of the display device according to the first embodiment.

FIG. 1 is a block diagram illustrating a configuration example of a display device according to a first embodiment for implementing the present invention. FIG. 2 is a conceptual diagram of an image display panel and an image display panel drive circuit of the display device according to the first embodiment. As illustrated in FIG. 1, a display device 10 includes a signal processing unit 20 that receives an input signal (for example, RGB data) and performs predetermined data conversion processing on the input signal to be output, an image display panel 40 that displays an image, an image display panel drive circuit 30 that controls driving of the image display panel 40 based on an output signal output from the signal processing unit 20, and a light source unit 50 that illuminates the image display panel 40 from a back surface thereof, for example.

The signal processing unit 20 controls operations of the image display panel 40 and the light source unit 50 in synchronization with each other. The signal processing unit 20 is coupled to the image display panel drive circuit 30 for driving the image display panel 40, and to the light source unit 50 that illuminates the image display panel 40. The signal processing unit 20 processes the input signal input from the outside to generate the output signal and a light source control signal. More specifically, the signal processing unit 20 converts, for example, an input value (input signal) of an input hue-saturation-value (HSV) color space indicated by the input signal into an extended value (output signal) of an extended HSV color space extended with components of a first color, a second color, a third color, and a fourth color to be generated, and outputs an output signal based on the extended value to the image display panel drive circuit 30. The signal processing unit 20 outputs the light source control signal corresponding to the output signal to the light source unit 50.

As illustrated in FIGS. 1 and 2, in the image display panel 40, a plurality of pixels 48 are arrayed in a two-dimensional matrix. In the example illustrated in FIG. 2 the pixels 48 are arrayed in a matrix on an XY two-dimensional coordinate system. In this example, a row direction is the X-direction, and a column direction is the Y-direction. In this way, the pixels 48 are arranged in a matrix along two directions intersecting with each other (the row direction and the column direction). As illustrated in FIG. 2, one pixel 48 includes a plurality of sub-pixels 49. The sub-pixels 49 will be described below.

The image display panel drive circuit 30 includes a signal output circuit 31 and a scanning circuit 32. The image display panel drive circuit 30 holds video signals using the signal output circuit 31, and sequentially outputs the video signals to the image display panel 40. The signal output circuit 31 is electrically coupled to the image display panel 40 via a wiring DTL. The image display panel drive circuit 30 performs control, by using the scanning circuit 32, to turn ON or OFF a switching element (for example, a thin film transistor (TFT)) for controlling an operation of a sub-pixel (for example, display luminance, and in this case, light transmittance) in the image display panel 40. The scanning circuit 32 is electrically coupled to the image display panel 40 via a wiring SCL.

The light source unit 50 includes a light source such as a light emitting diode (LED), and illuminates the image display panel 40 in response to supply of electric power and the light source control signal output from the signal processing unit 20. The light source unit 50 is arranged, for example, on the back surface of the image display panel 40, and emits light toward the image display panel 40 to illuminate the image display panel 40. The light source unit 50 adjusts electric current and a voltage to be supplied to the light source unit 50, and a duty ratio of a signal based on the light source control signal, and controls a quantity of light (light intensity) emitted to the image display panel 40. The light source unit 50 may be arranged on the front surface of the image display panel 40 as a front light. When a self-luminous display device such as an organic light emitting diode (OLED) display device is used as the image display panel 40, the light source unit 50 is not required.

Figure 3:
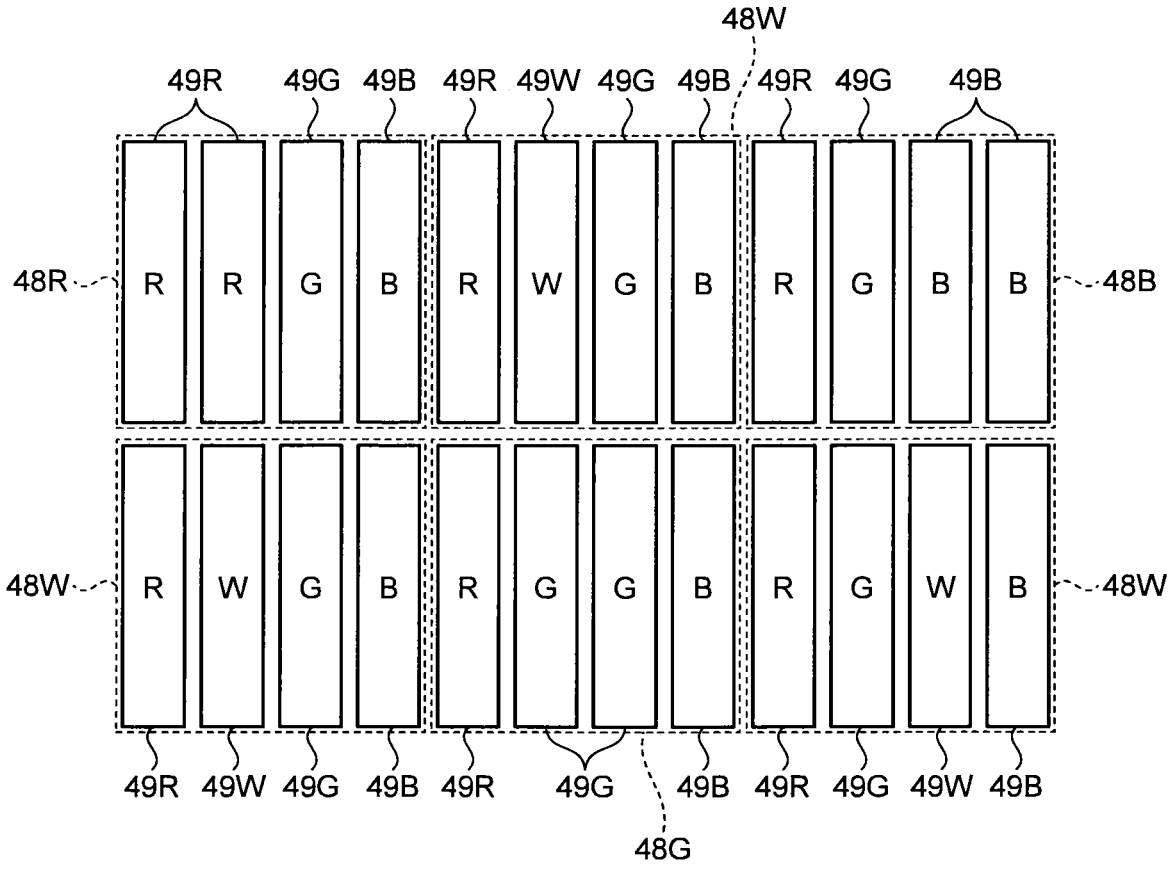
FIG. 3 is a diagram illustrating a pixel arrangement of a part of the image display panel according to the first embodiment.

FIG. 3 is a diagram illustrating a pixel arrangement of a part of the image display panel according to the first embodiment. As illustrated in FIGS. 2 and 3, the pixel 48 includes four sub-pixels 49. The pixel 48 includes at least a first sub-pixel 49R, a second sub-pixel 49G, and a third sub-pixel 49B. Some of the pixels 48 (pixels 48W) further include a fourth sub-pixel 49W. The four sub-pixels included in the pixel 48 are continuously arranged along a certain direction (for example, the row direction).

The first sub-pixel 49R displays a first color component (for example, red as a first primary color). The second sub-pixel 49G displays a second color component (for example, green as a second primary color). The third sub-pixel 49B displays a third color component (for example, blue as a third primary color). The fourth sub-pixel 49W displays a fourth color component (i.e., white). When it is not necessary to distinguish the first sub-pixel 49R, the second sub-pixel 49G, the third sub-pixel 49B, and the fourth sub-pixel 49W from one another, they are collectively referred to as the sub-pixels 49. As described above, in the first embodiment, the first color, the second color, and the third color correspond to red, green and blue, respectively. The fourth color corresponds to white in the first embodiment.

In the first embodiment, the components of the first color, the second color, the third color, and the fourth color of the extended HSV color space indicated by the output signal are assumed to correspond to the respective color components of the first sub-pixel 49R, the second sub-pixel 49G, the third sub-pixel 49B, and the fourth sub-pixel 49W. However, the color components of the output signal do not necessarily directly correspond to the color components of the sub-pixels 49. For example, maximum luminance of a single color that can be achieved by at least one of the color components of the sub-pixels 49 may be higher than maximum luminance of the single color that is defined in the extended HSV color space indicated by the output signal.

More specifically, the display device 10 is a transmissive color liquid crystal display device, for example. The image display panel 40 is a color liquid crystal display panel in which a first color filter that transmits the first primary color is arranged between the first sub-pixel 49R and an image observer, a second color filter that transmits the second primary color is arranged between the second sub-pixel 49G and the image observer, and a third color filter that transmits the third primary color is arranged between the third sub-pixel 49B and the image observer. In the image display panel 40, no color filter is arranged between the fourth sub-pixel 49W and the image observer. A transparent resin layer may be provided to the fourth sub-pixel 49W in place of the color filter.

In the example illustrated in FIG. 3, four sub-pixels 49 each having an equal area are arranged as a stripe array. However, the stripe array is merely an example, and the embodiment is not limited thereto. The structure and arrangement of four sub-pixels 49 included in one pixel 48 are not specifically limited. For example, in the image display panel 40, the four sub-pixels 49 may be arranged as an array that is similar to a diagonal array (mosaic array), a delta array (triangle array), or a rectangle array. The four sub-pixels do not necessarily have the equal area.

Typically, an array similar to the stripe array is suitable for displaying data and/or character strings in a personal computer and the like. On the other hand, an array similar to the mosaic array is suitable for displaying a natural image in a video camera recorder, a digital still camera, or the like. These relations between arrays and products are merely examples, and the embodiment is not limited thereto. The relations are optional.

The pixels 48 include the pixel 48W including one each of the first sub-pixel 49R, the second sub-pixel 49G, the third sub-pixel 49B, and the fourth sub-pixel 49W, and pixels 48R, 48G, and 48B each including four sub-pixels, where two of the sub-pixels are identical and are one of the first sub-pixel 49R, the second sub-pixel 49G, and the third sub-pixel 49B and the remaining two sub-pixels are different two of the first sub-pixel 49R, the second sub-pixel 49G, and the third sub-pixel 49B but are not one of the identical sub-pixels. A pixel including two first sub-pixels 49R, one second sub-pixel 49G, and one third sub-pixel 49B is assumed to be the pixel 48R. A pixel including two second sub-pixels 49G, one first sub-pixel 49R, and one third sub-pixel 49B is assumed to be the pixel 48G. A pixel including two third sub-pixels 49B, one first sub-pixel 49R, and one second sub-pixel 49G is assumed to be the pixel 48B. When it is not necessary to distinguish the pixels 48R, 48G, 48B, and 48W from one another, they are collectively referred to as the pixels 48. Unless specifically described, reference numerals of the pixels 48R, 48G, 48B, and 48W are used only for distinguishing the numbers of the first sub-pixels 49R, the second sub-pixels 49G, the third sub-pixels 49B, and the fourth sub-pixels 49W included in each of the pixels, and are not used for distinguishing arrangement orders of these sub-pixels 49.

Figure 4:
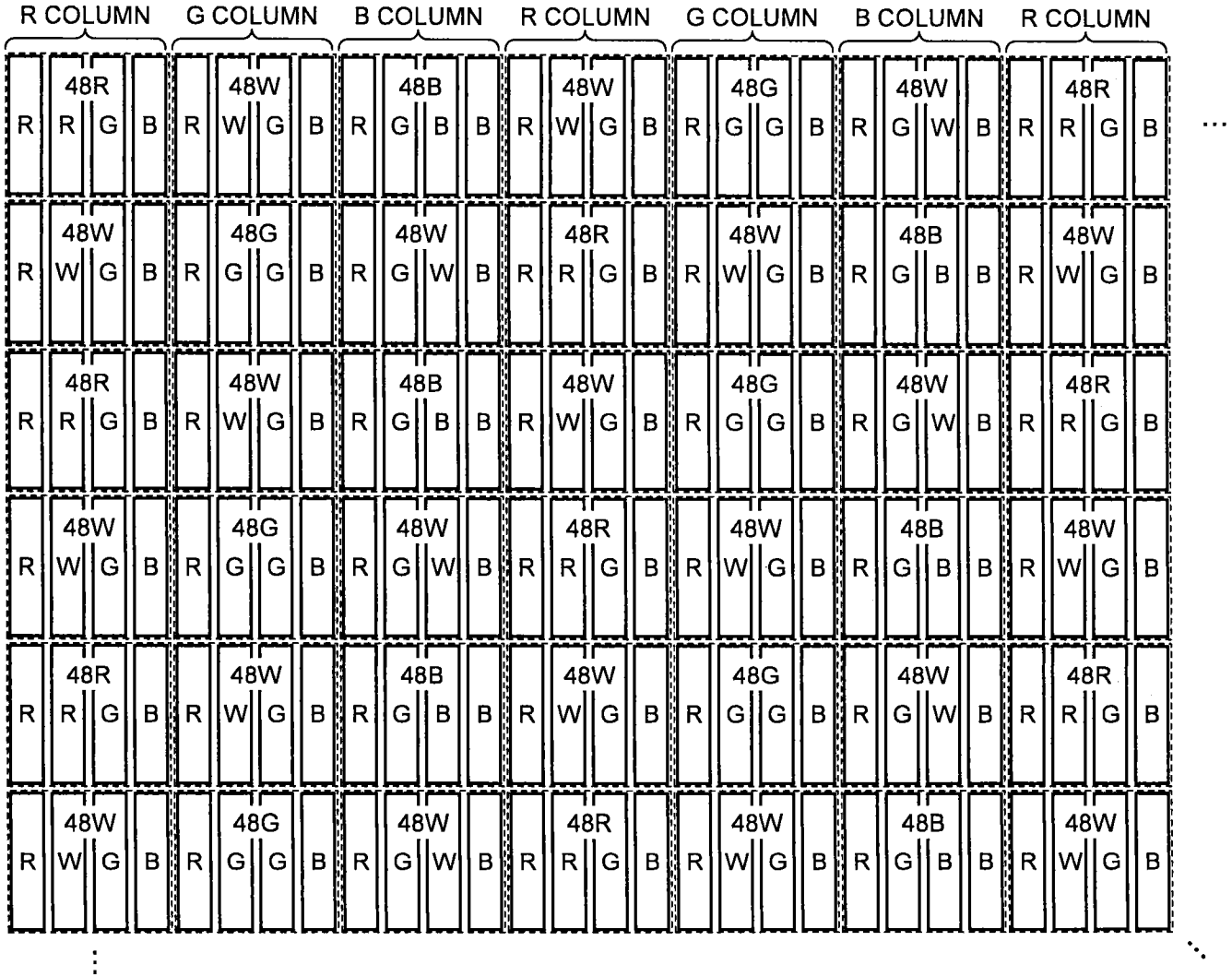
FIG. 4 is a diagram illustrating a pixel arrangement of a part of the image display panel according to the first embodiment in a wider range than that in FIG. 3.

FIG. 4 is a diagram illustrating a pixel arrangement of a part of the image display panel 40 according to the first embodiment in a wider range than that in FIG. 3. In FIG. 4 and some other figures, the reference numerals related to the sub-pixels 49 are omitted. In FIG. 4, a rectangle in which "R" is described represents the first sub-pixel 49R, a rectangle in which "G" is described represents the second sub-pixel 49G, a rectangle in which "B" is described represents the third sub-pixel 49B, and a rectangle in which "W" is described represents the fourth sub-pixel 49W. In FIG. 4 and some other figures, the reference numerals for distinguishing the pixels 48R, 48G, 48B, and 48W from one another are written on part of the rectangles representing the sub-pixels 49. In the image display panel 40, a pixel column (R column) in which the pixels 48R and the pixels 48W are alternately arranged along the column direction, a pixel column (G column) in which the pixels 48G and the pixels 48W are alternately arranged along the column direction, and a pixel column (B column) in which the pixels 48B and the pixels 48W are alternately arranged along the column direction, and the R, G, and B columns are periodically arranged in this order along the row direction. Further, in the image display panel 40, the pixels 48R, 48W, 48B, 48W, 48G, and 48W are periodically arranged in this order along the row direction.

The following describes a more specific arrangement of the pixels 48R, 48G, 48B, and 48W with reference to FIG. 4. In the description of an adjacent relation between a certain pixel 48 and another pixel 48 and an adjacent relation between a certain sub-pixel 49 and another sub-pixel 49, with reference to FIG. 4, the arrangement of the pixel 48 adjacent to the right side of a certain pixel 48 in the row direction may be referred to as "adjacently right", and the arrangement of the pixel 48 adjacent to the lower side of a certain pixel 48 in the column direction may be referred to as "adjacently below". Similarly, the arrangement of the sub-pixels 49 adjacent to the upper side and the lower side of a certain sub-pixel 49 in the column direction may be referred to as "vertically adjacent sides".

The pixel 48W of the G column is arranged adjacently right of the pixel 48R. The pixel 48B is arranged adjacently right of the pixel 48W of the G column. The pixel 48W of the R column is arranged adjacently right of the pixel 48B. The pixel 48G is arranged adjacently right of the pixel 48W of the R column. The pixel 48W of the B column is arranged adjacently right of the pixel 48G. The pixel 48R is arranged adjacently right of the pixel 48W of the B column. Subsequently, until reaching the right end of a pixel row included in the image display panel 40, the pixels are arranged in this order along the row direction. In the example illustrated in FIG. 4, the pixel column at the left end is the R column, so that the pixel 48 at the left end of each row is the pixel 48R or the pixel 48W of the R column. However, this arrangement is merely an example, and the embodiment is not limited thereto. The pixel column at the left end may be any pixel column (for example, the G column or the B column).

The pixel 48W of the R column is arranged adjacently below the pixel 48R. The pixel 48R is arranged adjacently below the pixel 48W of the R column. The pixel 48W of the G column is arranged adjacently below the pixel 48G. The pixel 48G is arranged adjacently below the pixel 48W of the G column. The pixel 48W of the B column is arranged adjacently below the pixel 48B. The pixel 48B is arranged adjacently below the pixel 48W of the B column. In each of the R column, the G column, and the B column, the pixels are arranged in this order along the column direction. In this way, in the image display panel 40, the pixels 48W are arranged in a hound's-tooth check pattern (like a checkered pattern). In other words, the pixel (pixel 48W) including the sub-pixel of the fourth color (fourth sub-pixel 49W) and the pixels (the pixels 48R, 48G, and 48B) not including the sub-pixel of the fourth color are alternately arranged along at least one of two directions (in the first embodiment, the row direction and the column direction).

The first sub-pixel 49R, the second sub-pixel 49G, and the third sub-pixel 49B in the pixel 48R are arranged in the order of, from the left to the right of the stripe array, the first sub-pixel 49R, the first sub-pixel 49R, the second sub-pixel 49G, and the third sub-pixel 49B. Similarly, the first sub-pixel 49R, the second sub-pixel 49G, and the third sub-pixel 49B in the pixel 48G are arranged in the order of the first sub-pixel 49R, the second sub-pixel 49G, the second sub-pixel 49G, and the third sub-pixel 49B. The first sub-pixel 49R, the second sub-pixel 49G, and the third sub-pixel 49B in the pixel 48B are arranged in the order of the first sub-pixel 49R, the second sub-pixel 49G, the third sub-pixel 49B, and the third sub-pixel 49B. In this way, two sub-pixels 49 of the same color included in one pixel 48 are adjacent to each other.

The first sub-pixels 49R are arranged on the vertically adjacent sides of the fourth sub-pixel 49W included in the pixel 48W of the R column. Therefore, as illustrated in FIG. 4, among the columns of the sub-pixels 49 arranged in the order of the first sub-pixel 49R, the first sub-pixel 49R, the second sub-pixel 49G, and the third sub-pixel 49B along the row direction in the R column, the first sub-pixels 49R included in one of the columns where the first sub-pixels 49R belong to (for example, the column of the first sub-pixels 49R adjacent to the second sub-pixels 49G) are alternately replaced with the fourth sub-pixel 49W. Similarly, the second sub-pixels 49G are arranged on the vertically adjacent sides of the fourth sub-pixel 49W included in the pixel 48W of the G column. The third sub-pixels 49B are arranged on the vertically adjacent sides of the fourth sub-pixel 49W included in the pixel 48W of the B column. In this way, in the column of the sub-pixels 49 in which the fourth sub-pixels 49W are arranged, the fourth sub-pixels 49W are arranged every other row.

An arrangement interval of the fourth sub-pixels 49W in the row direction has a predetermined periodicity. More specifically, as illustrated in FIG. 4 for example, the fourth sub-pixel 49W included in the pixel 48W of the B column is arranged on the right side of the fourth sub-pixel 49W included in the pixel 48W of the R column at an interval of every eight other sub-pixels 49 (the first sub-pixel 49R, the second sub-pixel 49G, or the third sub-pixel 49B). The fourth sub-pixel 49W included in the pixel 48W of the G column is arranged on the right side of the fourth sub-pixel 49W included in the pixel 48W of the B column at an interval of every six other sub-pixels 49. The fourth sub-pixel 49W included in the pixel 48W of the R column is arranged on the right side of the fourth sub-pixel 49W included in the pixel 48W of the G column at an interval of every seven other sub-pixels 49. In this way, the sub-pixels of the fourth color (fourth sub-pixels 49W) are arranged at a predetermined cycle along at least one of two directions (in the first embodiment, the row direction and the column direction).

Since the fourth sub-pixels 49W are arranged in the manner described above, the arrangement order of the first sub-pixel 49R, the second sub-pixel 49G, the third sub-pixel 49B, and the fourth sub-pixel 49W may be different depending on which column among the R column, the G column, and the B column the pixel 48W belongs to. In the pixel 48W of the R column and the pixel 48W of the G column, the first sub-pixel 49R, the fourth sub-pixel 49W, the second sub-pixel 49G, and the third sub-pixel 49B are arranged in this order from the left to the right of the stripe array. In the pixel 48W of the B column, the first sub-pixel 49R, the second sub-pixel 49G, the fourth sub-pixel 49W, and the third sub-pixel 49B are arranged in this order. These arrangement orders are merely an example, and the embodiment is not limited thereto. For example, the arrangement order of the first sub-pixel 49R, the second sub-pixel 49G, the third sub-pixel 49B, and the fourth sub-pixel 49W in the pixel 48W of the G column may be an arrangement order of the first sub-pixel 49R, the second sub-pixel 49G, the fourth sub-pixel 49W, and the third sub-pixel 49B.

The number of the sub-pixels of the first color (first sub-pixels 49R), the number of the sub-pixels of the second color (second sub-pixels 49G), and the number of the sub-pixels of the third color (third sub-pixels 49B) are the same. More specifically, a ratio among the number of the first sub-pixels 49R, the number of the second sub-pixels 49G, the number of the third sub-pixels 49B, and the number of the fourth sub-pixels 49W is 7:7:7:3.

Figure 5:
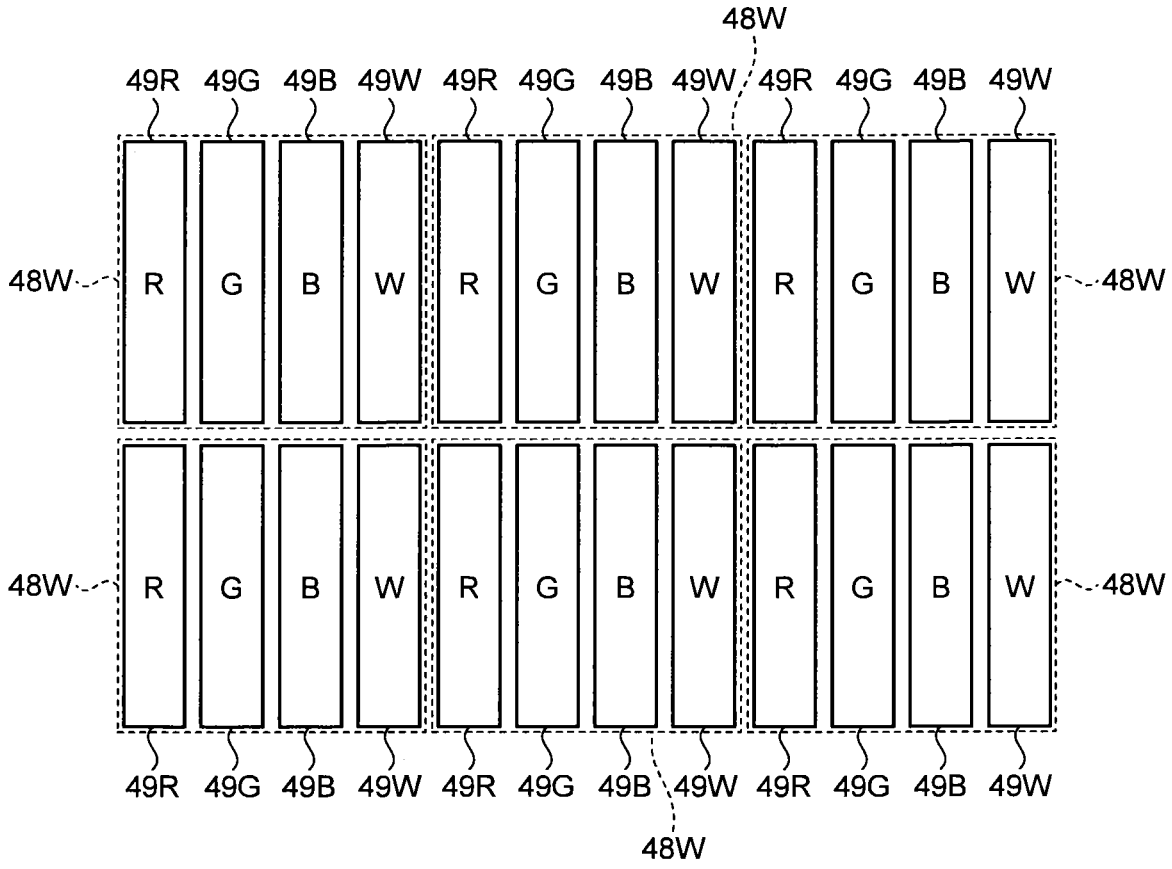
FIG. 5 is a diagram illustrating an image display panel of a conventional RGBW-type.

FIG. 5 is a diagram illustrating the image display panel 40 of the conventional RGBW-type. In the image display panel 40 of the RGBW-type in which all the pixels 48 are the pixels 48W as illustrated in FIG. 5, the ratio among the number of the first sub-pixels 49R, the number of the second sub-pixels 49G, the number of the third sub-pixels 49B, and the number of the fourth sub-pixels 49W is 1:1:1:1. Under the condition that a difference between the image display panel 40 according to the first embodiment illustrated in FIG. 4 and the image display panel 40 of the conventional type illustrated in FIG. 5 is only the color of the sub-pixel 49, the luminance of the first color component, the second color component, and the third color component in the image display panel 40 according to the first embodiment is 7/6 times higher than that of the first color component, the second color component, and the third color component in the image display panel 40 of the conventional type. In this way, according to the first embodiment, the luminance of the first color, the second color, and the third color can be further increased.

Figure 6:
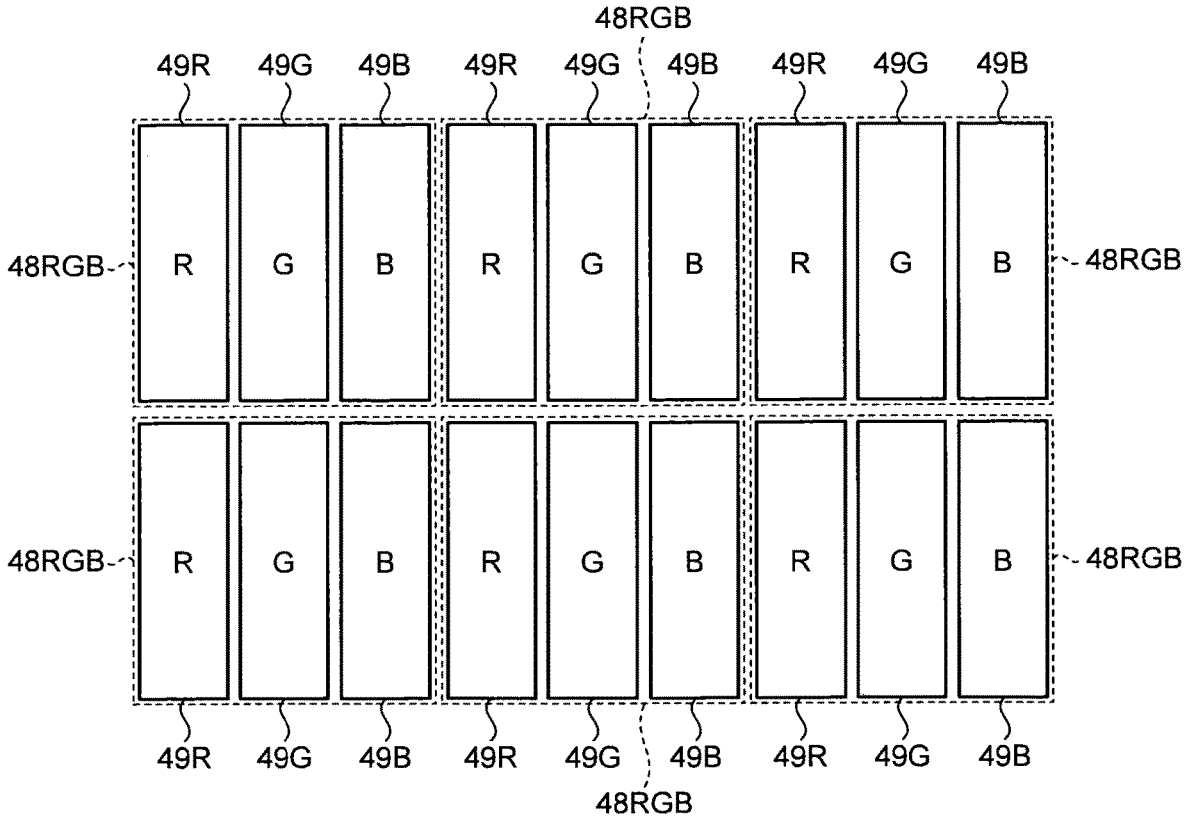
FIG. 6 is a diagram illustrating an image display panel of a conventional RGB-type.

FIG. 6 is a diagram illustrating the image display panel 40 of the conventional RGB-type. As illustrated in FIG. 6, the image display panel 40 of the conventional RGB-type constituted of a pixel 48RGB including only the first sub-pixel 49R, the second sub-pixel 49G, and the third sub-pixel 49B does not include the fourth sub-pixel 49W, so that an effect of including the fourth color component (for example, improvement in the luminance) cannot be achieved. On the other hand, the image display panel 40 according to the first embodiment includes the fourth sub-pixel 49W, so that the effect of including the fourth color component can be exhibited. In this way, according to the first embodiment, the effect obtained by using the fourth color in addition to the first color, the second color, and the third color as the color of the sub-pixel 49, and higher luminance of the first color, the second color, and the third color, can be achieved at the same time.

As described above, the signal processing unit 20 converts, for example, the input value (input signal) of the input HSV color space indicated by the input signal into the extended value (output signal) of the extended HSV color space extended with components of the first color, the second color, the third color, and the fourth color to be generated, and outputs the output signal based on the extended value to the image display panel drive circuit. In this case, since the pixel 48R, the pixel 48G, and the pixel 48B do not include the fourth sub-pixel 49W, the image display panel 40 cannot output the fourth color component. Thus, in the first embodiment, exception processing is performed on the pixel not including the fourth sub-pixel 49W. More specifically, as for the pixel 48R, the pixel 48G, and the pixel 48B, the image display panel 40 may output the first color component, the second color component, and the third color component disregarding the fourth color component, for example. The signal processing unit 20 may output the output signal corresponding to the pixel 48R, the pixel 48G, and the pixel 48B as the output signal corresponding to a color that can be extended only with the first color, the second color, and the third color in the extended HSV color space. The signal processing unit 20 may adjust the luminance using the fourth sub-pixel 49W in a pixel group unit of a predetermined combination. More specifically, in a case of the pixel arrangement illustrated in FIG. 4, for example, 2 pixels×3 pixels (row direction×column direction) are assumed to constitute one pixel group, a luminance component that can be converted into the fourth color in the pixel group and can be extended with the fourth sub-pixel 49W included in the pixel group may be distributed to the fourth sub-pixel 49W included in the pixel group, and the luminance of the other color components may be reduced by the luminance distributed to the fourth sub-pixel 49W. When a combination of the first color, the second color, and the third color constituting the input signal is red, green, and blue (RGB), an example of the luminance component that can be converted into the fourth color is a color component of a mixed color of all of the color components (white obtained by mixing RGB) corresponding to the smallest value among the luminance values of the color components indicated by the input signal. As a specific example, assuming that the input signal of RGB is "100, 100, and 50", the luminance component therein that can be converted into white is "50, 50, and 50". Distribution of each color in such conversion is appropriately set according to the first color, the second color, the third color, and the fourth color.

As described above, according to the first embodiment, the image display panel 40 functioning as a display unit includes the pixel (for example, the pixel 48W) including one each of four sub-pixels of four colors, i.e., the first color, the second color, the third color, and the fourth color that are different from one another (for example, the first sub-pixel 49R, the second sub-pixel 49G, the third sub-pixel 49B, and the fourth sub-pixel 49W), and the pixels (for example, the pixel 48R, the pixel 48G, and the pixel 48B) each including four sub-pixels, where two of the sub-pixels are identical and are one of the sub-pixels of the first color, the second color, and the third color, and the remaining two sub-pixels are different two of the sub-pixels of the first color, the second color, and the third color but are not one of the identical sub-pixels. Accordingly, under the condition that the sub-pixels of four colors, i.e., the first color, the second color, the third color, and the fourth color are included, the luminance of the first color, the second color, and the third color can be further increased. According to the first embodiment, the effect obtained by using the fourth color in addition to the first color, the second color, and the third color as the color of the sub-pixel, and higher luminance of the first color, the second color, and the third color, can be achieved at the same time.

The sub-pixels of the fourth color (for example, the fourth sub-pixels 49W) are arranged at a predetermined cycle along at least one of the two directions, so that the sub-pixels of the fourth color can be distributively arranged without being concentrated on a part of the display unit.

The pixel (pixel 48W) including the sub-pixel of the fourth color (fourth sub-pixel 49W) and the pixels not including the sub-pixel of the fourth color (the pixel 48R, the pixel 48G, and the pixel 48B) are alternately arranged along at least one of the two directions, so that the pixels including the sub-pixel of the fourth color can be distributively arranged without being concentrated on a part of the display unit.

The number of the sub-pixels of the first color (first sub-pixels 49R), the number of the sub-pixels of the second color (second sub-pixels 49G), and the number of the sub-pixels of the third color (third sub-pixels 49B) are the same, so that the luminance of these colors can be further increased while preventing biased increase in the luminance of a specific color among the first color, the second color, and the third color.

The two sub-pixels 49 of the same color included in one pixel 48 are adjacent to each other, so that the luminance of the color of the two sub-pixels 49 in a region of the adjacent two sub-pixels 49 can be further increased.

Modification of First Embodiment

Figure 7:
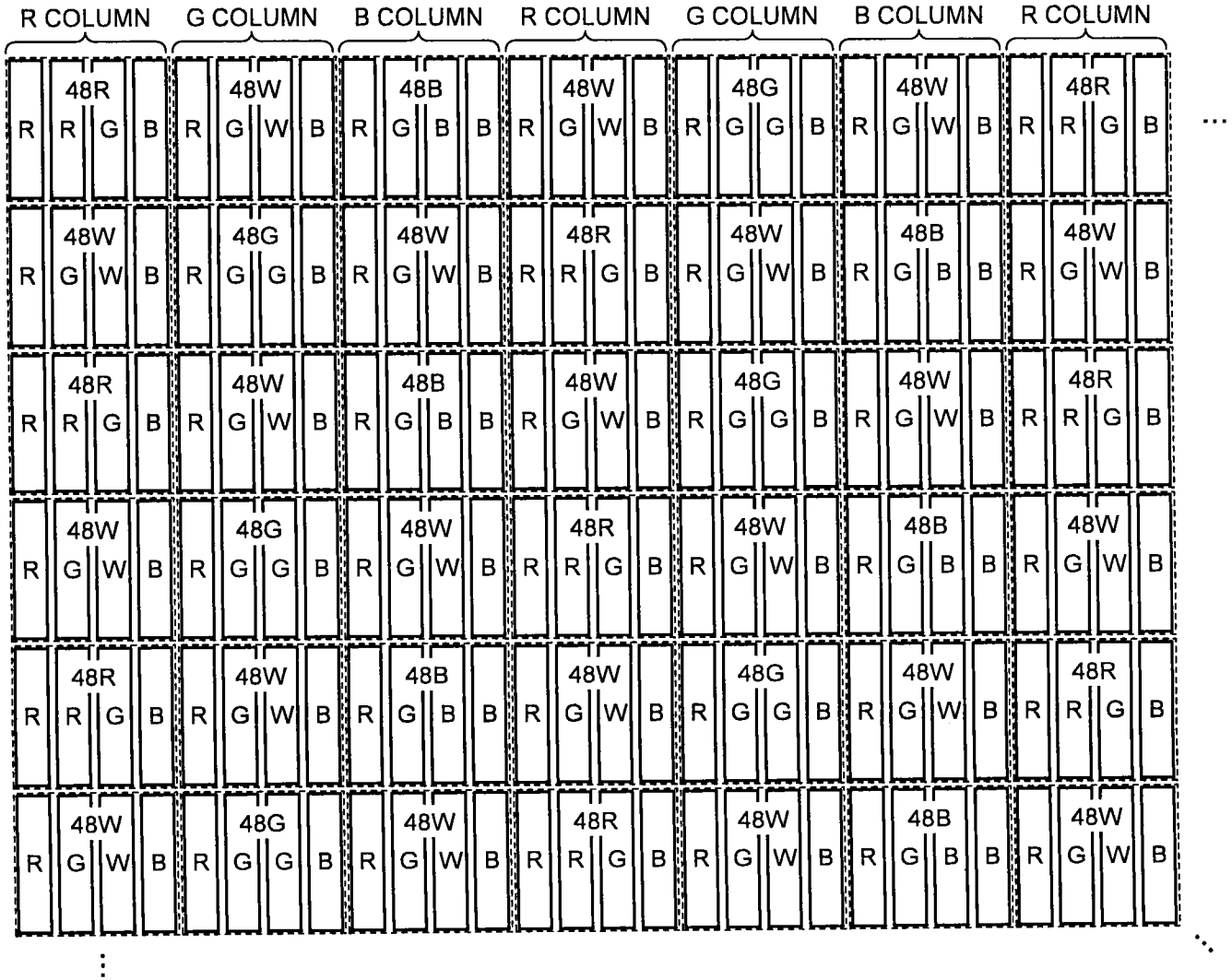
FIG. 7 is a diagram illustrating a pixel arrangement of a part of an image display panel according to a modification of the first embodiment.

FIG. 7 is a diagram illustrating a pixel arrangement of a part of the image display panel 40 according to a modification of the first embodiment. As illustrated in FIG. 7, the second sub-pixel 49G and the fourth sub-pixel 49W in the pixel 48W of FIG. 4 according to the first embodiment may be replaced with each other. In FIG. 7, the first sub-pixel 49R, the second sub-pixel 49G, the third sub-pixel 49B, and the fourth sub-pixel 49W in the pixel 48W are arranged in the order of, from the left to the right of the stripe array, the first sub-pixel 49R, the second sub-pixel 49G, the fourth sub-pixel 49W, and the third sub-pixel 49B.

In FIG. 7, the arrangement interval of the fourth sub-pixels 49W in the row direction has a predetermined periodicity. More specifically, as illustrated in FIG. 7 for example, the fourth sub-pixel 49W included in the pixel 48W of the B column is arranged on the right side of the fourth sub-pixel 49W included in the pixel 48W of the R column at an interval of every seven other sub-pixels 49 (the first sub-pixel 49R, the second sub-pixel 49G, or the third sub-pixel 49B). The fourth sub-pixel 49W included in the pixel 48W of the G column is arranged on the right side of the fourth sub-pixel 49W included in the pixel 48W of the B column at an interval of every seven other sub-pixels 49. The fourth sub-pixel 49W included in the pixel 48W of the R column is arranged on the right side of the fourth sub-pixel 49W included in the pixel 48W of the G column at an interval of every seven other sub-pixels 49. In this way, the sub-pixels of the fourth color (fourth sub-pixels 49W) are arranged at a predetermined cycle along at least one of the two directions (in the modification of the first embodiment, the row direction and the column direction).

In two adjacent columns of the pixels 48, three columns of the sub-pixels 49 are interposed between the column of the sub-pixels 49 where the fourth sub-pixels 49W are arranged in one of the adjacent two columns and the column of the sub-pixels 49 where the fourth sub-pixels 49W are arranged in the other one of the adjacent two columns. In this way, according to the modification of the first embodiment, the fourth sub-pixels 49W are arranged at regular intervals.

According to the modification of the first embodiment, the same effect as that of the first embodiment can be obtained. More specifically, under the condition that the sub-pixels of four colors, i.e., the first color, the second color, the third color, and the fourth color are included, the luminance of the first color, the second color, and the third color can be further increased. According to the modification of the first embodiment, the effect obtained by using the fourth color in addition to the first color, the second color, and the third color as the color of the sub-pixel, and higher luminance of the first color, the second color, and the third color, can be achieved at the same time. The sub-pixels of the fourth color can be distributively arranged without being concentrated on a part of the display unit. The luminance of the first color, the second color, and the third color can be further increased while preventing biased increase in the luminance of a specific color among these colors. The luminance of the color of the two adjacent sub-pixels 49 in a region of the two sub-pixels 49 can be further increased. The fourth sub-pixels 49W are arranged at regular intervals, so that the sub-pixels of the fourth color can be distributively arranged more uniformly.

Second Embodiment

Figure 8:
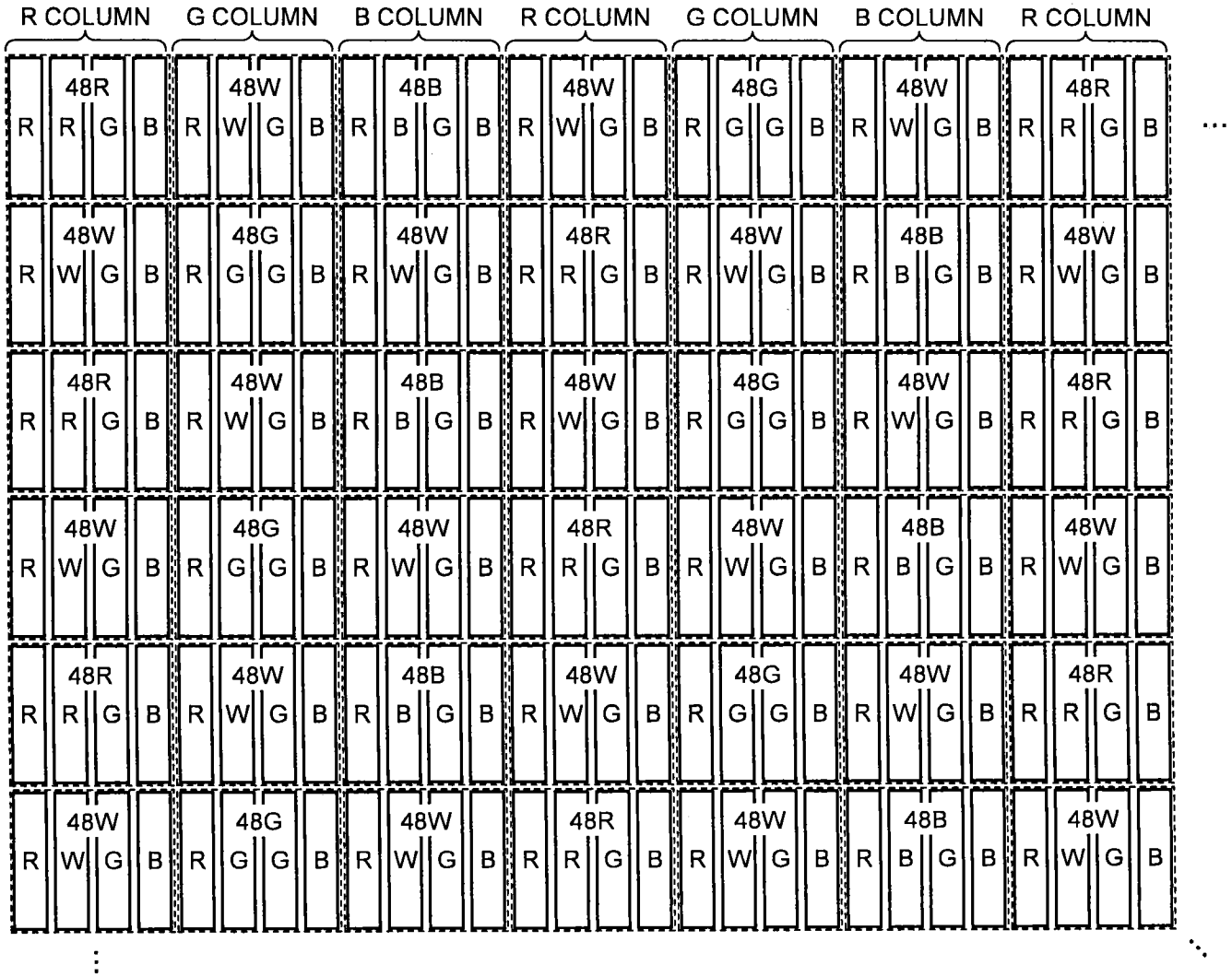
FIG. 8 is a diagram illustrating a pixel arrangement of a part of an image display panel according to a second embodiment.

Next, the following describes a second embodiment for implementing the present invention. The same component as that of the first embodiment may be denoted by the same reference numeral, and the description thereof may be omitted. FIG. 8 is a diagram illustrating a pixel arrangement of a part of the image display panel 40 according to the second embodiment. The range illustrated in FIG. 8 corresponds to the range illustrated in FIG. 4. As illustrated in FIG. 8, the arrangement of the sub-pixels 49 of the B column according to the second embodiment is such that the second sub-pixel 49G of the B column in the first embodiment is replaced with the third sub-pixel 49B or the fourth sub-pixel 49W of the B column. Except this difference in the arrangement, the second embodiment is the same as the first embodiment.

More specifically, the first sub-pixel 49R, the second sub-pixel 49G, and the third sub-pixel 49B in the pixel 48B of the B column are arranged in the order of, from the left to the right of the stripe array, the first sub-pixel 49R, the third sub-pixel 49B, the second sub-pixel 49G, and the third sub-pixel 49B. Similarly, the first sub-pixel 49R, the second sub-pixel 49G, the third sub-pixel 49B, and the fourth sub-pixel 49W in the pixel 48W of the B column are arranged in the order of the first sub-pixel 49R, the fourth sub-pixel 49W, the second sub-pixel 49G, and the third sub-pixel 49B.

According to the arrangement of the sub-pixels 49 of the B column as described above, in the second embodiment, the fourth sub-pixel 49W included in the pixel 48W of the B column is arranged on the right side of the fourth sub-pixel 49W included in the pixel 48W of the R column at an interval of every seven other sub-pixels 49 (the first sub-pixel 49R, the second sub-pixel 49G, or the third sub-pixel 49B). The fourth sub-pixel 49W included in the pixel 48W of the G column is arranged on the right side of the fourth sub-pixel 49W included in the pixel 48W of the B column at an interval of every seven other sub-pixels 49. The fourth sub-pixel 49W included in the pixel 48W of the R column is arranged on the right side of the fourth sub-pixel 49W included in the pixel 48W of the G column at an interval of every seven other sub-pixels 49. In two adjacent columns of the pixels 48, three columns of the sub-pixels 49 are interposed between the column of the sub-pixels 49 where the fourth sub-pixels 49W are arranged in one of the adjacent two columns and the column of the sub-pixels 49 where the fourth sub-pixels 49W are arranged in the other one of the adjacent two columns. In this way, according to the second embodiment, the fourth sub-pixels 49W are arranged at regular intervals.

According to the second embodiment, in addition to obtaining the same effect as that of the first embodiment, the fourth sub-pixels 49W are arranged at regular intervals, so that the sub-pixels of the fourth color can be distributively arranged more uniformly.

Modification of Second Embodiment

Figure 9:
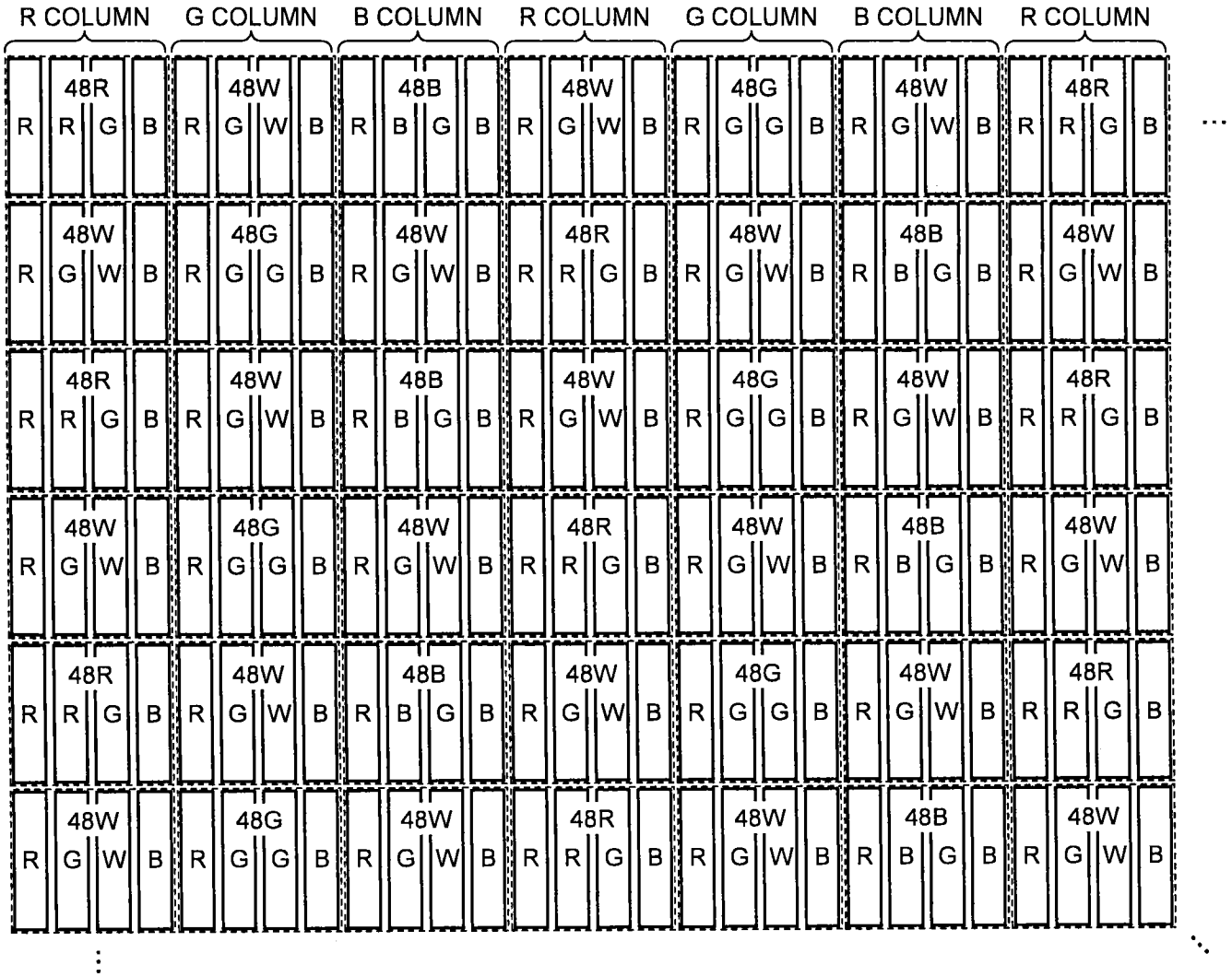
FIG. 9 is a diagram illustrating a pixel arrangement of a part of an image display panel according to a modification of the second embodiment.

FIG. 9 is a diagram illustrating a pixel arrangement of a part of the image display panel 40 according to a modification of the second embodiment. As illustrated in FIG. 9, the third sub-pixel 49B and the fourth sub-pixel 49W in the pixel 48W of FIG. 8 may be replaced with each other. In FIG. 9, the first sub-pixel 49R, the second sub-pixel 49G, the third sub-pixel 49B, and the fourth sub-pixel 49W in the pixel 48W are arranged in the order of, from the left to the right of the stripe array, the first sub-pixel 49R, the second sub-pixel 49G, the fourth sub-pixel 49W, and the third sub-pixel 49B.

According to the arrangement of the pixels 48W as described above, in the modification of the second embodiment, the fourth sub-pixel 49W included in the pixel 48W of the B column is arranged on the right side of the fourth sub-pixel 49W included in the pixel 48W of the R column at an interval of every seven other sub-pixels 49 (the first sub-pixel 49R, the second sub-pixel 49G, or the third sub-pixel 49B). The fourth sub-pixel 49W included in the pixel 48W of the G column is arranged on the right side of the fourth sub-pixel 49W included in the pixel 48W of the B column at an interval of every seven other sub-pixels 49. The fourth sub-pixel 49W included in the pixel 48W of the R column is arranged on the right side of the fourth sub-pixel 49W included in the pixel 48W of the G column at an interval of every seven other sub-pixels 49. In two adjacent columns of the pixels 48, three columns of the sub-pixels 49 are interposed between the column of the sub-pixels 49 where the fourth sub-pixels 49W are arranged in one of the adjacent two columns and the column of the sub-pixels 49 where the fourth sub-pixels 49W are arranged in the other one of the adjacent two columns. In this way, according to the modification of the second embodiment, the fourth sub-pixels 49W are arranged at regular intervals.

According to the modification of the second embodiment, in addition to obtaining the same effect as that of the first embodiment, the fourth sub-pixels 49W are arranged at regular intervals, so that the sub-pixels of the fourth color can be distributively arranged more uniformly.

Third Embodiment

Figure 10:
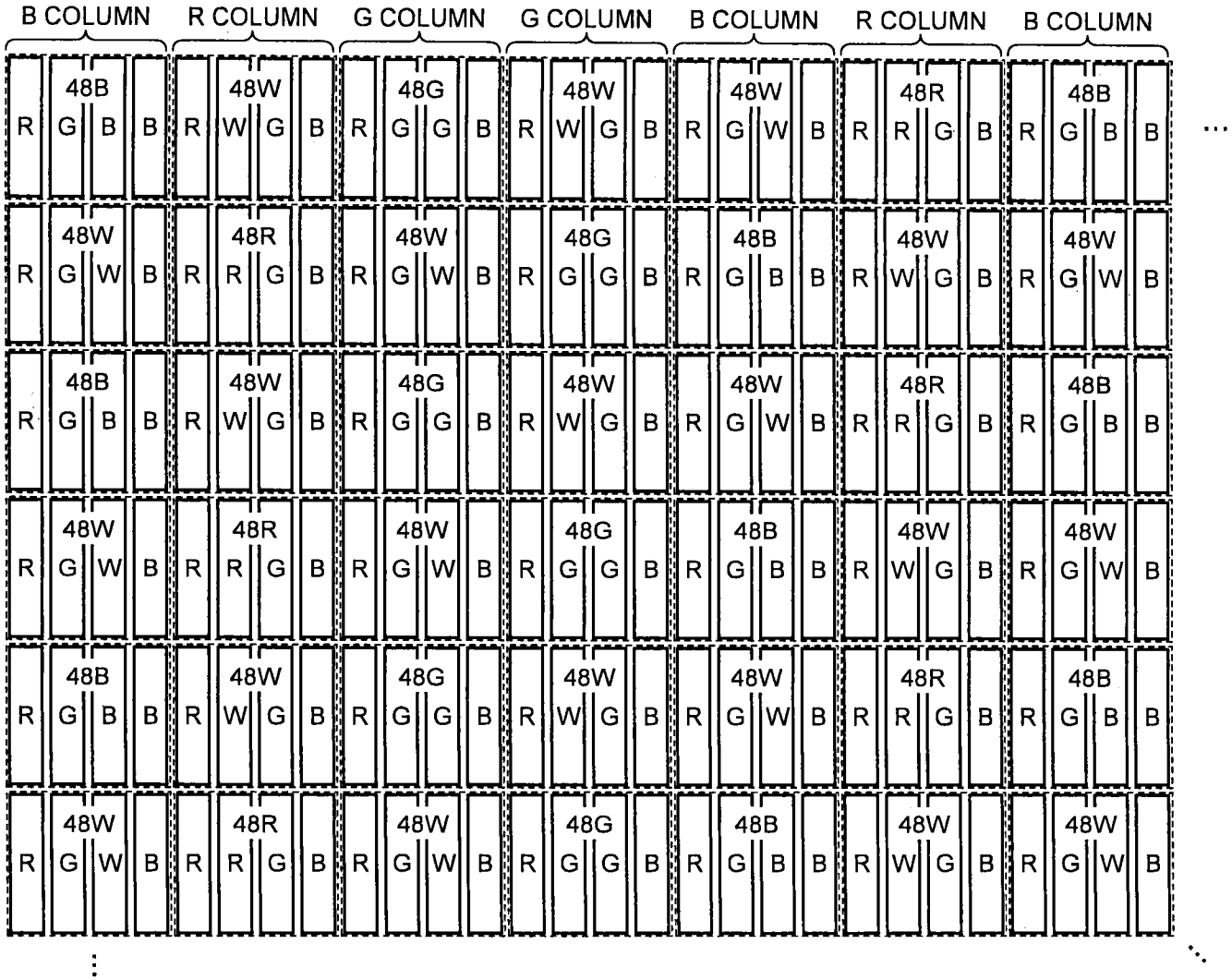
FIG. 10 is a diagram illustrating a pixel arrangement of a part of an image display panel according to a third embodiment.

Next, the following describes a third embodiment for implementing the present invention. The same component as that of the first embodiment may be denoted by the same reference numeral, and the description thereof may be omitted. FIG. 10 is a diagram illustrating a pixel arrangement of a part of the image display panel 40 according to the third embodiment. As illustrated in FIG. 10, in the third embodiment, the pixel columns along the row direction are arranged in the order of, from the left, the B column, the R column, the G column, the G column, the B column, and the R column. In the image display panel 40 according to the third embodiment, sets of the pixel columns arranged in this order (the B column, the R column, the G column, the G column, the B column, and the R column) are periodically arranged along the row direction.

In the third embodiment, the pixels 48W are not arranged at every other pixel in the row direction. More specifically, for example, in the uppermost pixel row in FIG. 10, the pixel 48B, the pixel 48W of the R column, the pixel 48G, the pixel 48W of the G column, the pixel 48W of the B column, and the pixel 48R are arranged in this order from the left end of the sets of the pixel columns. In this case, when the pixel 48W is represented as "present" and pixels other than the pixel 48W are represented as "absent", the pixels are represented as "absent", "present", "absent", "present", "present", and "absent" in this order. In the third embodiment, the fourth sub-pixel 49W included in the pixel 48W of the G column is arranged on the right side of the fourth sub-pixel 49W included in the pixel 48W of the R column at an interval of every seven other sub-pixels 49 (the first sub-pixel 49R, the second sub-pixel 49G, or the third sub-pixel 49B). Except this difference in the arrangement of the pixel columns and the pixel 48W (fourth sub-pixel 49W), the third embodiment is the same as the first embodiment. For confirmation, in the third embodiment, the pixels 48W are arranged at every other pixel in the column direction similarly to the first embodiment.

According to the third embodiment, the same effect as that of the first embodiment can be exhibited.

Fourth Embodiment

Figure 11:
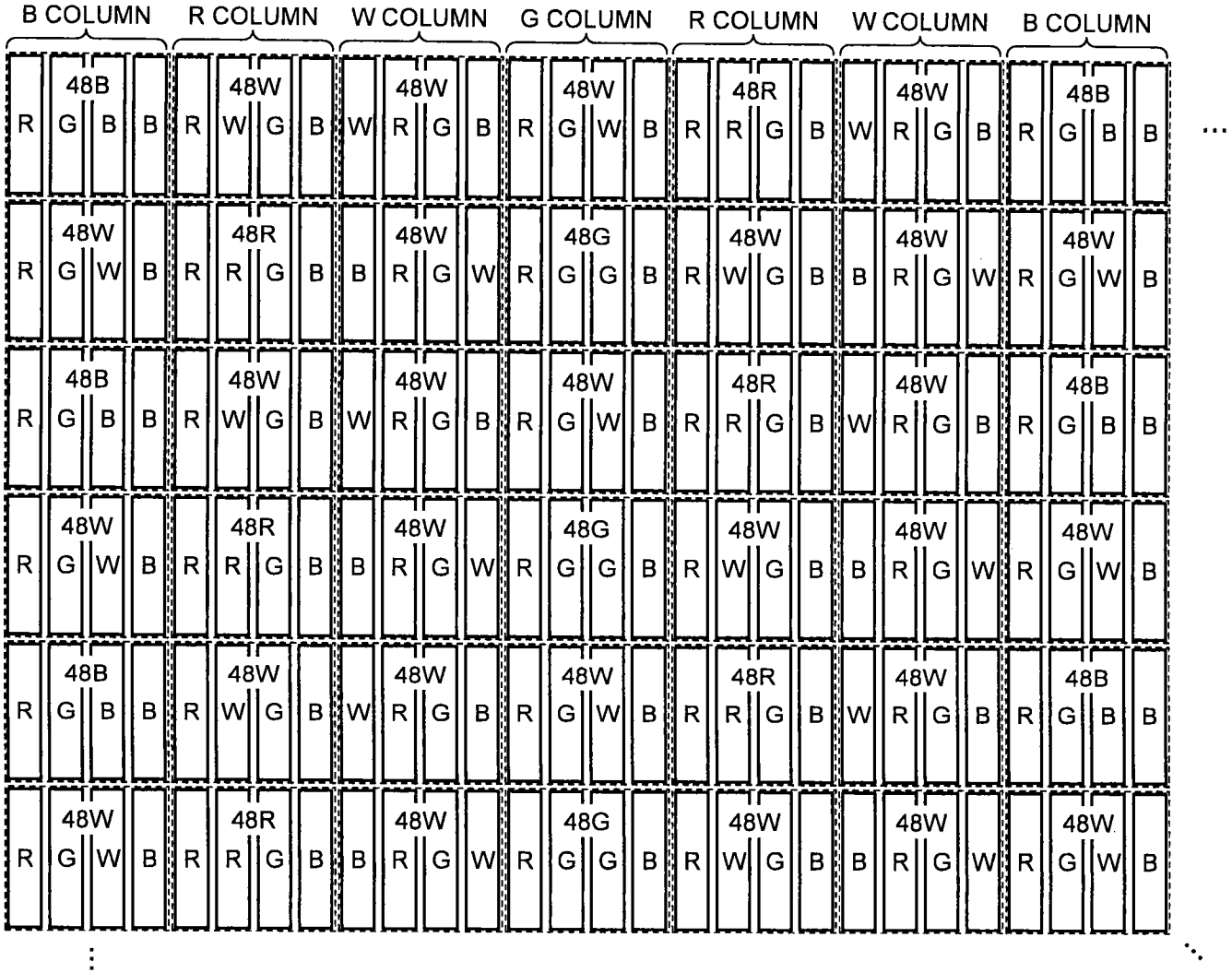
FIG. 11 is a diagram illustrating a pixel arrangement of a part of an image display panel according to a fourth embodiment.

Next, the following describes a fourth embodiment for implementing the present invention. The same component as that of the first embodiment may be denoted by the same reference numeral, and the description thereof may be omitted. FIG. 11 is a diagram illustrating a pixel arrangement of a part of the image display panel 40 according to the fourth embodiment. As illustrated in FIG. 11, the image display panel 40 according to the fourth embodiment includes a pixel column (W column) constituted of only the pixels 48W. The W column is a pixel column in which the pixel 48W including the sub-pixels 49 arranged in the order of the fourth sub-pixel 49W, the first sub-pixel 49R, the second sub-pixel 49G, and the third sub-pixel 49B from the left to the right of the stripe array and the pixel 48W including the sub-pixels 49 arranged in the order of the third sub-pixel 49B, the first sub-pixel 49R, the second sub-pixel 49G, and the fourth sub-pixel 49W from the left to the right of the stripe array are alternately arranged in the column direction. In the example illustrated in FIG. 11, the pixel columns are arranged along the row direction in the order of the B column, the R column, the W column, the G column, the R column, and the W column, from the left. In the image display panel 40 according to the fourth embodiment, the sets of the pixel columns arranged in this order are periodically arranged along the row direction.

In the fourth embodiment, among the number of the sub-pixels of the first color (first sub-pixels 49R), the number of the sub-pixels of the second color (second sub-pixels 49G), and the number of the sub-pixels of the third color (third sub-pixels 49B), the number of the sub-pixels 49 of at least one of the colors is different from the number of the sub-pixels of the other colors. More specifically, in the example illustrated in FIG. 11, a ratio among the number of the first sub-pixels 49R, the number of the second sub-pixels 49G, the number of the third sub-pixels 49B, and the number of the fourth sub-pixels 49W is 14:13:13:8. The example illustrated in FIG. 11 is applied to the image display panel 40 which shows a tendency of color reproduction such that the first color component is deficient as compared with the second color component and the third color component when the number of the sub-pixels of the first color (first sub-pixels 49R), the number of the sub-pixels of the second color (second sub-pixels 49G), and the number of the sub-pixels of the third color (third sub-pixels 49B) are the same as described in the first to third embodiments. In this way, according to the fourth embodiment, color balance of the image display panel 40 can be adjusted by adjusting the ratio of the color components in the sub-pixels 49. In the example illustrated in FIG. 11, the number of the first sub-pixels 49R is relatively large in the sub-pixels 49 to further enhance the first color component. However, this is merely an example, and distribution of the color components in the sub-pixels 49 according to the fourth embodiment is not limited thereto. For example, to further enhance the second color component, either or both of the number and the arrangement of the first sub-pixels 49R may be replaced with those of the second sub-pixels 49G illustrated in FIG. 11. The same applies to a case of further enhancing the third color component. In the fourth embodiment, the distribution of the sub-pixels 49 of the respective color components is appropriately determined according to a tendency of excess and deficiency of the color components. However, in the fourth embodiment, a condition is applied such that the fourth sub-pixels 49W are necessarily provided to one or more pixels among a plurality of pixels included in the image display panel 40, and are not provided to all the pixels 48. Also applied is a condition that, in the fourth embodiment, all the pixels 48 necessarily include one or more of each of the first sub-pixel 49R, the second sub-pixel 49G, and the third sub-pixel 49B. Under such conditions, the ratio among the numbers of the first sub-pixel 49R, the second sub-pixel 49G, the third sub-pixel 49B, and the fourth sub-pixel 49W is adjusted.

According to the fourth embodiment, the color balance of the display unit (for example, the image display panel 40) can be adjusted by varying the ratio of the respective color components of the sub-pixels 49.

Application Examples

Figure 12:
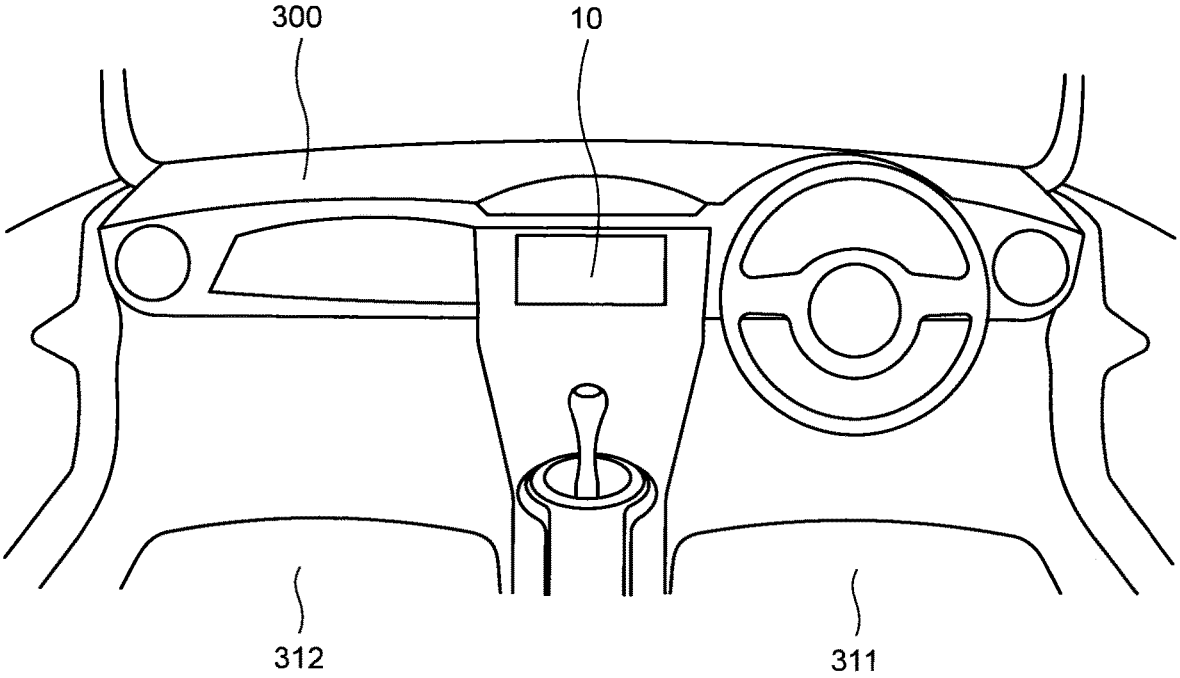
FIG. 12 is a diagram illustrating an example of an electronic apparatus to which the display device according to each embodiment is applied.
Figure 13:
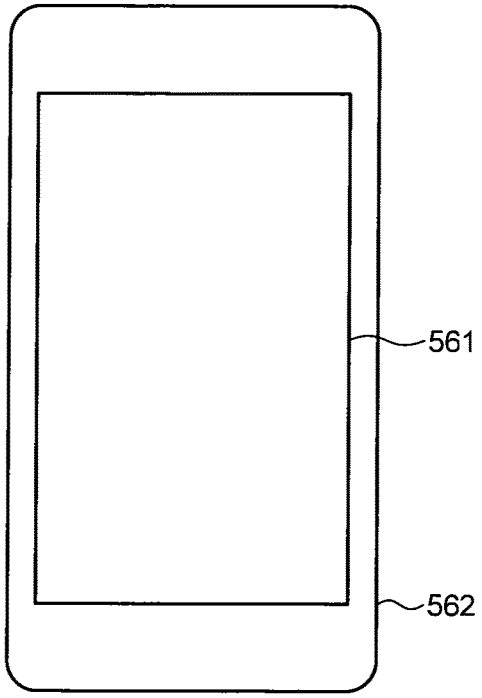
FIG. 13 is a diagram illustrating an example of an electronic apparatus to which the display device according to each embodiment is applied.

Next, the following describes application examples of the display device 10 described in each embodiment with reference to FIGS. 12 and 13. FIGS. 12 and 13 are diagrams each illustrating an example of an electronic apparatus to which the display device according to each embodiment is applied. The display device 10 according to each embodiment can be applied to electronic apparatuses in various fields such as a car navigation system illustrated in FIG. 12, a television apparatus, a digital camera, a laptop personal computer, a portable terminal device including a mobile phone illustrated in FIG. 13, or a video camera. In other words, the display device 10 according to each embodiment can be applied to electronic apparatuses in various fields that display a video signal input from the outside or a video signal generated inside as an image or video. The application examples can be applied to display devices according to other embodiments, modifications, and other examples other than the display device 10 according to each embodiment.

The electronic apparatus illustrated in FIG. 12 is a car navigation device to which the display device 10 according to each embodiment is applied. The display device 10 is installed on a dashboard 300 inside an automobile. More specifically, the display device 10 is installed on the dashboard 300 between a driver's seat 311 and a passenger seat 312. The display device 10 of the car navigation device is utilized for displaying navigation, displaying a music operation screen, reproducing and displaying movies, or the like.

The electronic apparatus illustrated in FIG. 13 is a portable information terminal that operates as a mobile computer, a multifunctional mobile phone, a mobile computer capable of making a voice call, or a mobile computer capable of performing communications, to which the display device 10 according to each embodiment is applied, and may be referred to as what is called a smartphone or a tablet terminal. The portable information terminal includes a display unit 561 on a surface of a housing 562, for example. The display unit 561 includes the display device 10 according to each embodiment and has a touch detection (i.e., a touch panel) function capable of detecting an external proximity object.

Even though the embodiments and the modifications of the present invention have been described above, the embodiments and the modifications are not limited thereto. The components described above include a component that is easily conceivable by those skilled in the art, a component that is substantially identical thereto, and a component within a range of equivalents. The components described above can also be appropriately combined with one another. In addition, the components can be omitted, replaced, and modified in various manners without departing from the gist of the embodiments and the modifications described above. For example, the display device 10 may include a self-luminous image display panel 40 that lights a self-luminous body such as an organic light-emitting diode (OLED). The color for each sub-pixel (the first color, the second color, the third color, or the fourth color) can be determined using a luminescent material, instead of the color filter.

In the above embodiments, the HSV color space is employed as a color space of the color indicated by the input signal and the output signal. However, the HSV color space is merely an example of a color space that can be employed according to the present invention, and the embodiments are not limited thereto. Another color space may also be employed. The colors of the sub-pixels are not limited to red, green, blue, and white. At least one of these colors may be replaced with another color. As a specific example, a color such as yellow (Y) may be employed in place of white. In place of three primary colors including red, green, and blue, colors such as cyan (C), magenta (M), and yellow (Y) may be employed.

The present invention naturally encompasses other working effects caused by the aspects described in the above embodiments that are clear from the description herein or that are appropriately conceivable by those skilled in the art.

The present invention includes the following aspects:

(1) A display device comprising a display unit in which a plurality of pixels are arranged, wherein one pixel includes four sub-pixels, and wherein the display unit includes:

a pixel including one each of four sub-pixels of four different colors that are a first color, a second color, a third color, and a fourth color; and a pixel including four sub-pixels, where two of the four sub-pixels are identical and are one of sub-pixels of the first color, the second color, and the third color, and remaining two of the four sub-pixels are different two of the sub-pixels of the first color, the second color, and the third color but are not one of the identical sub-pixels.

(2) The display device according to (1), wherein the plurality of pixels are arranged in a matrix along two directions intersecting with each other, and wherein sub-pixels of the fourth color are arranged at a predetermined cycle along at least one of the two directions.

(3) The display device according to either (1) or (2), wherein the plurality of pixels are arranged in a matrix along two directions intersecting with each other, and wherein a pixel including a sub-pixel of the fourth color and a pixel not including the sub-pixel of the fourth color are alternately arranged along at least one of the two directions.

(4) The display device according to either (1) or (2), wherein a number of sub-pixels of the first color, a number of sub-pixels of the second color, and a number of sub-pixels of the third color are equal.

(5) The display device according to either (1) or (2), wherein, among a number of sub-pixels of the first color, a number of sub-pixels of the second color, and a number of sub-pixels of the third color, a number of sub-pixels of at least one of the colors is different from a number of sub-pixels of the other colors.

(6) The display device according to either (1) or (2), wherein two sub-pixels of identical color included in one pixel are adjacent to each other.

(7) The display device according to either (1) or (2), wherein the first color, the second color, and the third color are red, green, and blue, respectively.

(8) The display device according to either (1) or (2), wherein the fourth color is white.

(9) The display device according to either (1) or (2), wherein the four sub-pixels included in the one pixel are continuously arranged along a certain direction.

What is claimed is:

1. A display device comprising a display unit in which a plurality of pixels are arranged in a matrix along a first direction and a second direction orthogonal to the first direction, wherein the pixels include:

a first pixel including four sub-pixels of four different colors that are a first color, a second color, a third color, and a fourth color that is white; and a second pixel including four sub-pixels, each of which has one of three colors that are the first color, the second color, and the third color, wherein the four subpixels in the second pixel are:

two same-color sub-pixels that have a same color as one of the three colors; and remaining two sub-pixels having colors different from each other, colors of the remaining two sub-pixels being different from the color of the two same-color sub-pixels, wherein the sub-pixels of the pixels arranged in the matrix are arranged such that the sub-pixels of a same color, which include one of the two same-color sub-pixels of the same color, are continuously aligned:

in the second direction, the two same-color sub-pixels in the second pixels being adjacent to each other in the first direction, a sub-pixel of the fourth color in the first pixel being arranged between the two same-color sub-pixels of the second pixels that are adjacent to each other in the second direction; or in the first direction, the two same-color sub-pixels in the second pixels being adjacent to each other in the second direction, a sub-pixel of the fourth color in the first pixel being arranged between the two same-color sub-pixels of the second pixels that are adjacent to each other in the first direction, and wherein the first pixel and the second pixel are alternately arranged along at least one of the first direction and the second direction.

2. The display device according to claim 1, wherein sub-pixels of the fourth color are arranged at a predetermined cycle along at least one of the first direction and the second direction.

3. The display device according to claim 1, wherein, among the subpixels of the pixels arranged in the matrix, a first number is a number of the sub-pixels of the first color, a second number is a number of the sub-pixels of the second color, and a third number is number of the sub-pixels of the third color, and wherein the first number, the second number, and the third number are equal.

4. The display device according to claim 1, wherein, among the subpixels of the pixels arranged in the matrix, a first number is a number of the sub-pixels of the first color, a second number is a number of the sub-pixels of the second color, and a third number is a number of the sub-pixels of the third color, and wherein the first number, the second number, and the third number are not equal.

5. The display device according to claim 1, wherein the first color, the second color, and the third color are red, green, and blue, respectively.

6. The display device according to claim 1, wherein the four sub-pixels included in each of the pixels are continuously arranged along one of the first direction and the second direction.

7. The display device according to claim 1, wherein the sub-pixels of the pixels are arranged in the matrix such that the sub-pixels of a same color, which include one of the two same-color sub-pixels of the same color, are continuously aligned:

in the second direction, the two same-color sub-pixels in the second pixels being adjacent to each other in the first direction, and one of the sub-pixels of the fourth color being disposed between the two same-color sub-pixels of the same color in the second sub-pixels adjacent to each other in the second direction; or in the first direction, the two same-color sub-pixels in the second pixels being adjacent to each other in the second direction, and one of the sub-pixels of the fourth color being disposed between the two same-color sub-pixels of the same color in the second sub-pixels adjacent to each other in the first direction.

* * * * *